United States Patent [19]

Tognoli et al.

[11] Patent Number: 4,703,890

[45] Date of Patent: Nov. 3, 1987

[54] COMPONENTS FOR BALLAST-LESS RAILROAD LINES LAID ON PRE-FABRICATED REINFORCED CONCRETE SLABS

[75] Inventors: Pietro Tognoli; Gianfranco Cremaschi, both of Gorlago; Antonio Migliacci; Giancarlo Bono, both of Milan, all of Italy

[73] Assignee: I.P.A. S.p.A. Industria Prefabbricati, Gergamo, Italy

[21] Appl. No.: 17,031

[22] Filed: Feb. 17, 1987

Related U.S. Application Data

[63] Continuation of Ser. No. 753,311, Jul. 9, 1985, abandoned.

[30] Foreign Application Priority Data

Jul. 27, 1984 [IT] Italy ..... 22084 A/84

[51] Int. Cl.[4] ..... E01B 1/00

[52] U.S. Cl. ..... 238/7; 238/2; 104/11

[58] Field of Search ..... 238/1, 2, 3, 5, 6, 7, 238/8, 9; 104/11

[56] References Cited

U.S. PATENT DOCUMENTS

| | | | |
|---|---|---|---|
| 739,899 | 9/1903 | Mullen | 238/9 |
| 3,878,987 | 4/1975 | Uzuka | 104/11 |
| 4,010,896 | 3/1977 | Stockton | 238/7 X |
| 4,232,822 | 11/1980 | Hahn et al. | 238/7 |
| 4,232,823 | 11/1980 | Eggermann | 238/2 |
| 4,266,719 | 5/1981 | Ortwein et al. | 238/7 X |
| 4,641,779 | 2/1987 | O'Brien et al. | 238/7 |

FOREIGN PATENT DOCUMENTS

| | | | |
|---|---|---|---|
| 2354960 | 11/1973 | Fed. Rep. of Germany | 238/7 |
| 2906165 | 8/1980 | Fed. Rep. of Germany | 238/5 |
| 3019531 | 11/1981 | Fed. Rep. of Germany | 238/2 |

OTHER PUBLICATIONS

Civil Engineering Newsletter, "*Floating Slabs, Padded Rails Keep Metro Quiet*" National Capital Section, ASCE, vol. XXII, No. 7, Feb. 1975.

*Primary Examiner*—Robert B. Reeves
*Assistant Examiner*—Glenn B. Foster
*Attorney, Agent, or Firm*—Karl F. Ross; Herbert Dubno

[57] ABSTRACT

Ballastless railroad lines are laid on prefabricated reinforced concrete slabs, which can eliminate the need for periodic maintenance of the ballast of traditional railroad lines, such maintenance being expensive and often difficult to carry out. Prefabricated, possibly prestressed, slabs are thereby positoned upon a steel reinforced concrete block having the functions of a foundation and connector for the prefabricated slabs with the interposition of a concrete-asphalt mortar layer between the slabs and block. The slabs are secured to the foundation block either by means of two half-cylinders, forming parts of the slab structure, or by shoulders formed by upturned sides of the foundation block (tub).

5 Claims, 12 Drawing Figures

1
2
3
4
7
8
II
III

COMPONENTS FOR BALLAST-LESS RAILROAD LINES LAID ON PRE-FABRICATED REINFORCED CONCRETE SLABS

This is a continuation of co-pending application Ser. No. 753,311 filed on July 9, 1985, now abandoned.

FIELD OF THE INVENTION

This invention relates to components for ballast-less railroad lines laid on pre-fabricated reinforced concrete slabs.

BACKGROUND OF THE INVENTION

Traditional railroad lines, whether laid on wooden or reinforced concrete sleepers, require periodic maintenance of the ballast, which is an expensive and awkward procedure. Frequently such maintenance must be carried out in difficult environmental conditions, as at bridges or tunnels.

In fact, owing to particular morphological conditions and alignment limitations (gradients of a few units per thousand), both in Italy and most foreign countries, modern railroad lines are largely laid in tunnels or bridges and viaducts.

The need for novel approaches, in laying railroad lines, which can do without the traditional ballast system, is therefore apparent.

Known systems are being tested or used on various national railroad lines, which provide for the use of platforms for transferring the loads to the underlying ground and providing a rigid support for the rails. In particular, a series of systems provide for the utilization of concrete platforms cast in the field, reinforced with slack steel reinforcement wherein pre-stressed reinforced concrete sleepers are embedded which support the rails. That approach, while affording a number of advantages, brings about some problems the most important of which are the impossibility of reacting in an effective way to sagging due to settling of the underlying ground. A problem of durability stems from the fact that the concrete cast in situ, even if of excellent quality and prepared with adequate additives, when subjected to high dynamic loads and especially to repeated temperature changes, soon becomes cracked which results in deterioration of the concrete due to water infiltration.

This cracked state is specially objectionable at the contact sections between pre-fabricated sleepers and the cast work, where owing to the mechanical and rheological conditions of the two different concrete types, cracking and separation phenomena can readily develop.

Another system, in use with Japanese railroad lines, provides for the platform to be formed of pre-fabricated elements laid on a continuous foundation of concrete constituting the bottom of a tunnel or the scaffolding of a bridge, with the interposition of a bitumen mortar layer and possibly a rubber layer. The bond between the pre-fabricated elements and the foundation is provided by a concrete cylinder (stopper) integrated with the foundation by casting in situ and protruding therefrom. This system also has, however, disadvantages the most important of which is the rapid rate of deterioration of the weakest parts of the system, in particular of the bitumen mortar and rubber which, at the joint between the pre-fabricated element and the stopper, is left exposed to weather and temperature changes, as well as to the aggressive agents present along railroad lines.

OBJECTS OF THE INVENTION

It is a primary object of this invention to obviate such prior disadvantages by providing components for ballast-less railroad lines laid on concrete slabs which can combine, with a highly stable alignment both in the vertical and horizontal directions, the possibility of reducing the maintenance requirements to a significant extent, and which can ensure, thanks to the configurations of the components, materials used, and production methods employed, reduced deterioration of the railroad structure.

Another object of this invention is to enable rapid realignment of the platform in the event of any sagging along sections laid directly on the ground.

It is a further object to advantageously decrease the depth from the plane of the rails to that of the civil structures, whether the floor of a tunnel or that of a bridge, which decrease allows, e.g. in existing tunnels, a height reclaim useful for electrification, while affording a significant reduction of the structural load on bridges and viaducts.

SUMMARY OF THE INVENTION

These and other objects are achieved by the components of this invention being essentially characterized in that pre-fabricated reinforced concrete slabs are provided, which may be pre-stressed in one or two directions and constitute the platform, being positioned on a foundation block, reinforced with steel reinforcements and cast in situ, having foundation and bonding functions for the prefabricated slabs.

BRIEF DESCRIPTION OF THE DRAWING

Illustrated by way of example and not of limitation, in the accompanying drawings, are two embodiments of the invention which differ from each other by the anchoring method employed therefor. In the drawing:

FIG. 5A is an end view of the assembly of FIG. 5;

FIG. 5B is a side view of this assembly;

SPECIFIC DESCRIPTION

Figures 1, 1A, 1B:
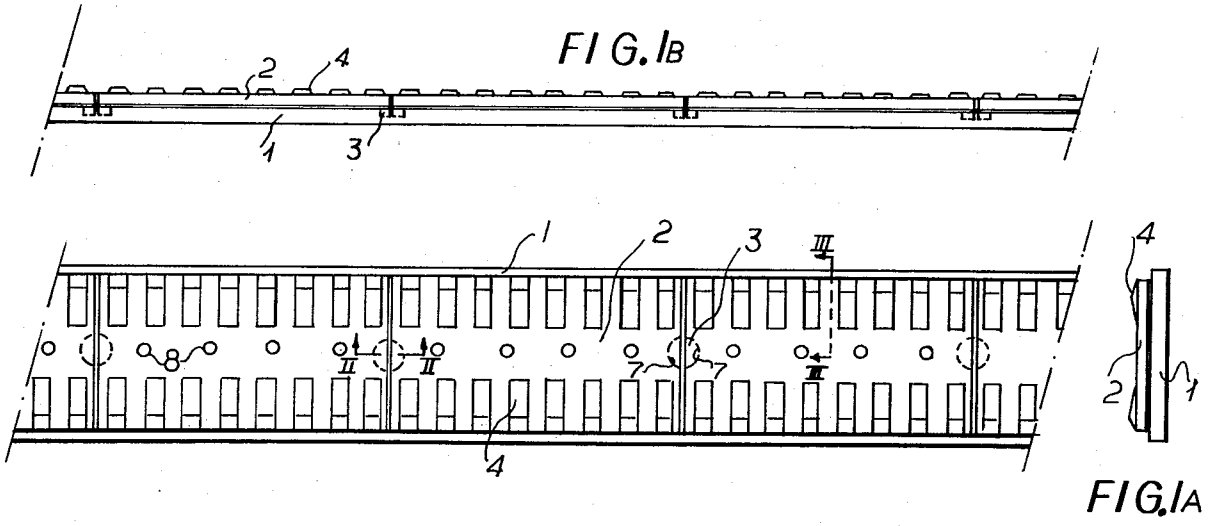
FIG. 1 is a plan view of the railroad bed assembly of the present invention.
FIG. 1A is an end view of the concrete support body and slab assembly.
FIG. 1B is a side view of this assembly.

FIGS. 1A and 1B show a plan view and two side views of the concrete block 1 and pre-fabricated slabs 2.

Figure 2:
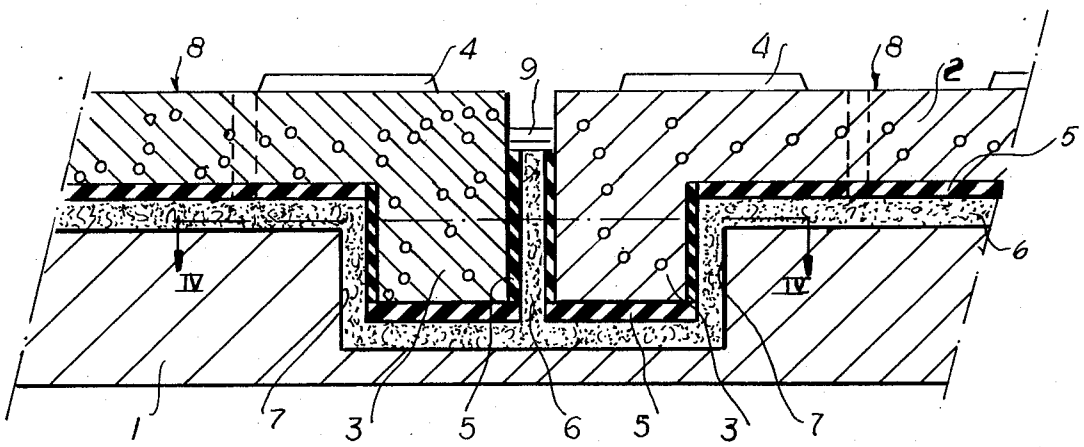
FIG. 2 is a section taken along the line II—II of FIG. 1.
Figure 3:
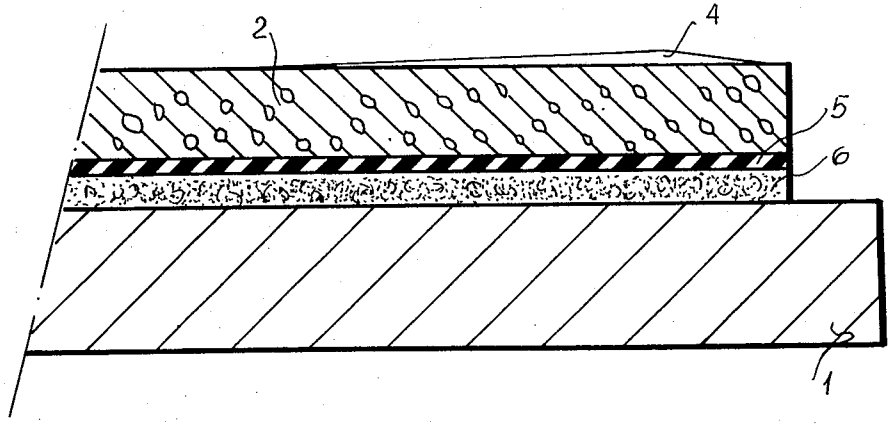
FIG. 3 is a section taken along the line III—III of FIG. 1.

FIG. 2 shows the block 1 and slabs 2, bringing out the anchoring half-cylinders 3, elevations 4 bearing the rails, vibration-damping rubber layer 5, concrete-asphalt mortar layer 6, and the seats 7 for the half-cylinders 3, holes 8 for injecting the concrete-asphalt mortar therethrough, resin sealing 9.

Figure 4:
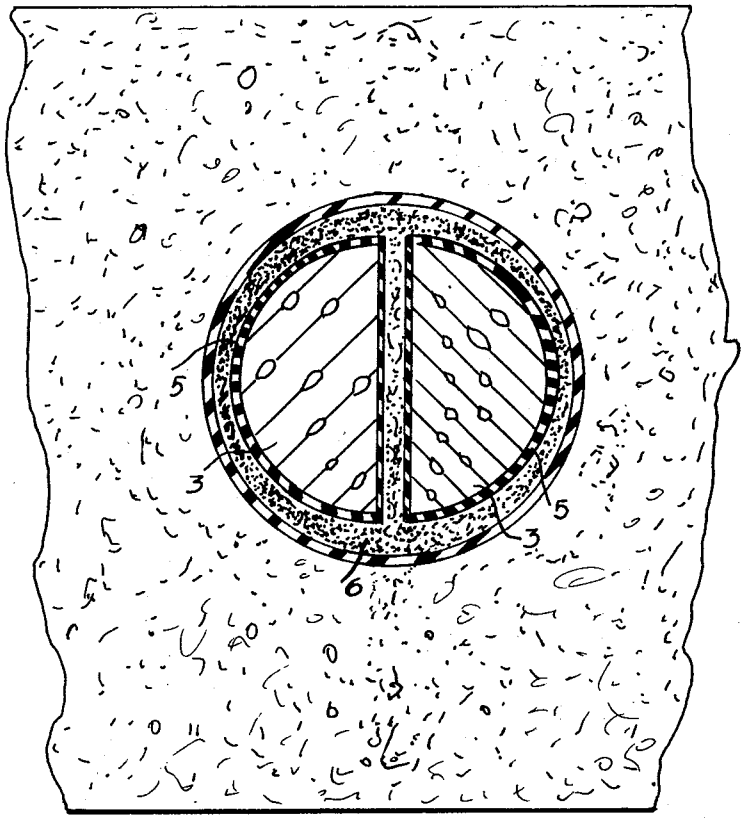
FIG. 4 is a section taken along the line IV—IV of FIG. 2.
Figure 5:
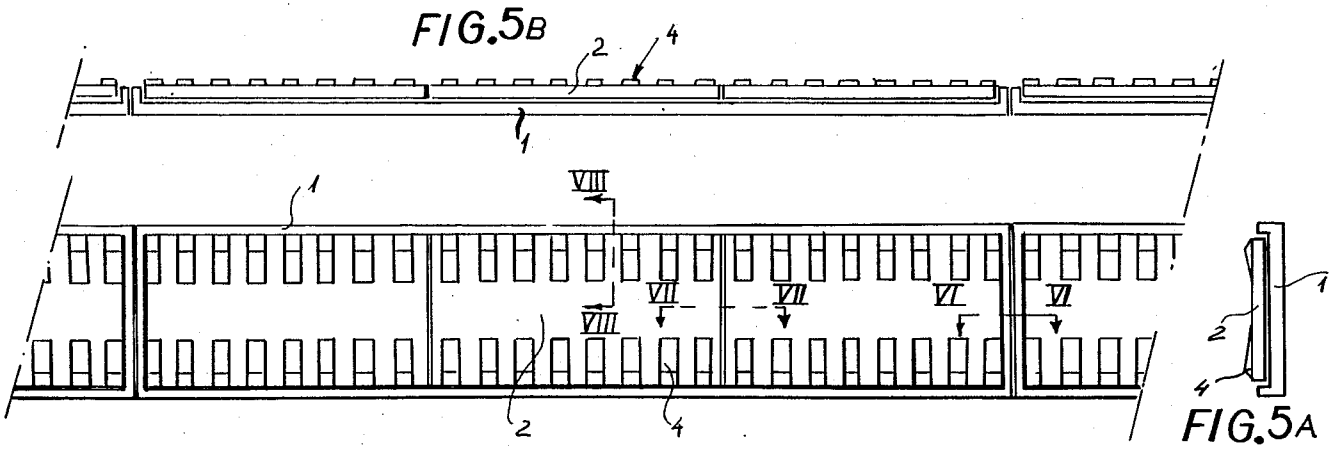
FIG. 5 is a plan view similar to FIG. 1 in another embodiment of the invention.
Figure 6:
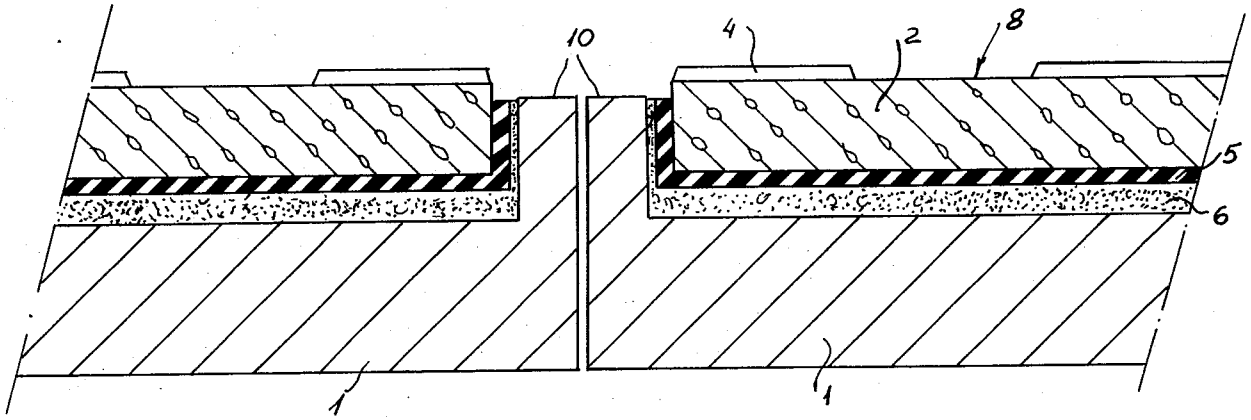
FIG. 6 is a cross section taken along the line VI—VI of FIG. 5.
Figure 7:
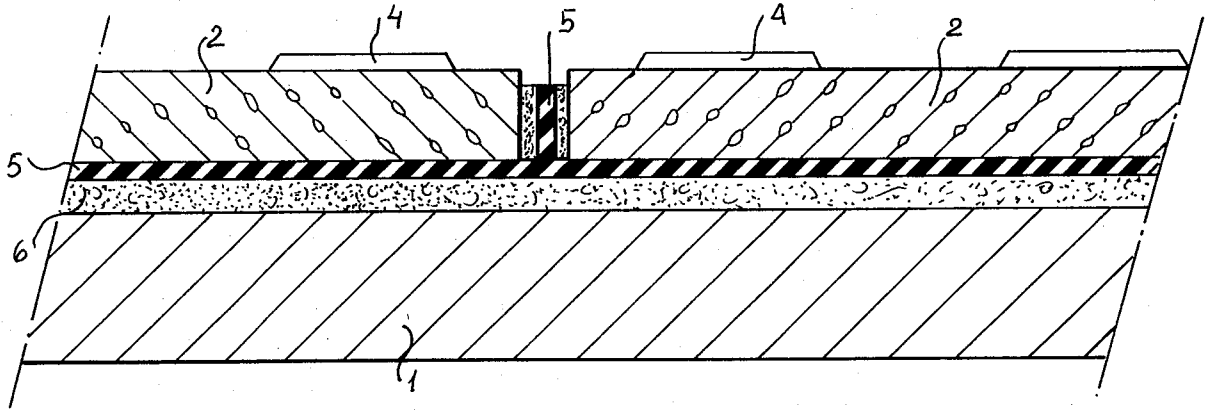
FIG. 7 is a cross section taken along the line VII—VII of FIG. 5.
Figure 8:
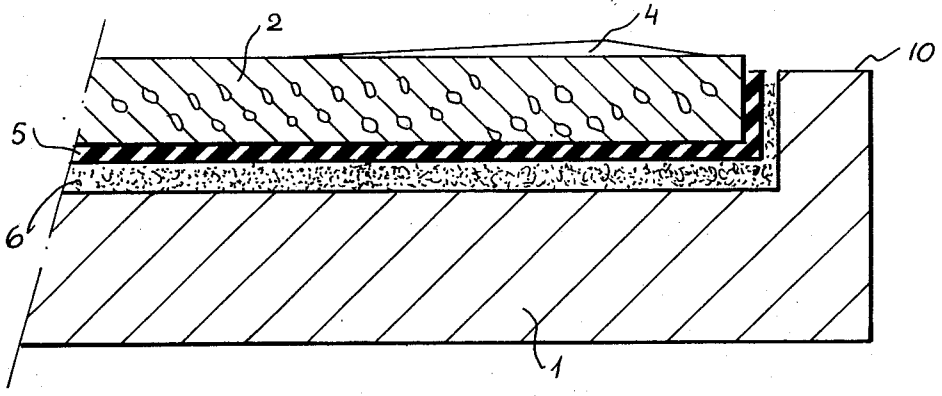
FIG. 8 is a section taken along the line VIII—VIII of FIG. 5.

The anchoring for the pre-fabricated slabs by means of the two half-cylinders 3 positioned in the seat 7 can be seen in FIG. 4.

The steel reinforced block 1 is formed from concrete using fluidizer and aerating additives; the fluidizer having the function of reducing the amount of water to the slurry, to ensure the required processibility but impart to the concrete with a high degree of compaction and reduce shrinkage. The aerating agent has the function of imparting to the concrete a high degree of imperviousness. In the foundation body 1, which provides a regular monolithic, adequately rigid, support for the pre-fabricated slabs 2, there are formed cylindrical seats 7 which allow for the insertion of slab anchoring half-cylinders 3.

The pre-fabricated reinforced concrete slabs 2, which may be pre-stressed in both directions, have the function of transferring the loads impressed by the rail on the foundation to the ground, thereby providing a stable and adequately elastic support for the rails.

Each slab 2 is provided, at the top face thereof, with shaped elevations 4 adapted to provide the required slope for lying the rails, at the bottom face thereof, with a sheet of fluted vibration-damping rubber 5, and along its side faces, with a band of solid rubber having the purpose of ensuring effective sound insulation and insulation from the transferred vibration.

Each slab is further formed with holes 8 at regular intervals, for injecting the concrete-asphalt mortar 6 therethrough.

From the bottom face of the concrete slab there depend two half-cylinders 3 forming parts of the slab structure, which serve the function of anchoring the slabs to the block cast in situ, both in connection with the accelerations and decelerations transferred from the railroad vehicles, and with the thermal actions of the pre-fabricated slabs and the rails.

Assembling is performed by laying the prefabricated slabs 2 on the block 1 cast in situ, positioning in the seats 7 the half-cylinders 3 which provide for the anchoring. On completion of the slab alignment, there is injected through the holes 8 the concrete-asphalt mortar 6 with additives, which is caused to completely fill the space between the block 1 cast in situ and the pre-fabricated slabs 2, in particular the mortar will fill the spaces between the half-cylinders 3 and their seats 7 while being advantageously shielded by the slabs themselves the joints whereof are sealed with resins 9 as shown in FIG. 2.

The second embodiment of this invention is illustrated particularly by FIGS. 5 to 8.

This embodiment differs from the first, discussed hereinabove, by the system of anchoring the prefabricated slabs, which is provided in this instance by the side edges 10 of the foundation block 1 being upturned along the block periphery to form a constraint to lengthwise and crosswise movements.

We claim:

1. A ballastless railroad line bed, comprising:

an elongated steel-reinforced concrete support block, said support block being formed with spaced apart upwardly open cylindrical seats;

a plurality of rectangular prefabricated reinforced concrete slabs along said block and supported thereby, said slabs having confronting edges along which they are provided unitarily with downwardly projecting semicylindrical protuberances of concrete, each of said seats receiving a respective semicylindrical protuberance of each of two successive slabs along said bed, whereby two protuberances extend into each seat with spacing from one another, the two protuberances in each seat having flat surfaces juxtaposed with one another and cylindrically convex surfaces turned away from one another, said two protuberances being received with all around clearance in the respective seat, said slabs and said support block defining spaces between them at least along the entire underside of said slabs; and respective layers of a yieldable concrete asphalt mortar injected into and substantially filling said spaces.

2. The railroad line bed defined in claim 1 further comprising a layer of rubber interposed between said mortar and said slabs and its protuberance, said mortar being injected between said layer of rubber and said body and extending into said seats.

3. The railroad bed defined in claim 2 wherein the layer of rubber along the underside of each of said slabs is a fluted rubber sheet.

4. The railroad line bed defined in claim 3 wherein each of said slabs is formed with shaped elevations adapted to receive rails and having inclinations providing a required slope for said rails.

5. The railroad bed as defined in claim 4 wherein said slabs are formed with holes at regular intervals to permit the injection of said mortar into said spaces.

* * * * *

UNITED STATES PATENT AND TRADEMARK OFFICE

CERTIFICATE OF CORRECTION

PATENT NO. : 4,703,890

DATED : November 3, 1987

INVENTOR(S) : Pietro TOGNOLI et al

It is certified that error appears in the above-identified patent and that said Letters Patent is hereby corrected as shown below: On the title page Item [73] Assignee's name and address are to read:

-- I.P.A. S.P.A. INDUSTRIA PREFABBRICATI AFFINI
Bergamo, ITALY --

Signed and Sealed this

Tenth Day of May, 1988

*Attest:*

*Attesting Officer*

DONALD J. QUIGG

*Commissioner of Patents and Trademarks*